United States Patent [19]

Swann

[11] 4,104,494

[45] Aug. 1, 1978

[54] ELECTRIC SWITCHES

[76] Inventor: David Allen Swann, 17-21 Carinish Rd., Clayton, Victoria, 3168, Australia

[21] Appl. No.: 752,283

[22] Filed: Dec. 20, 1976

Related U.S. Application Data

[63] Continuation of Ser. No. 634,176, Nov. 21, 1975, abandoned.

[30] Foreign Application Priority Data

Nov. 25, 1974 [AU] Australia ..... 9740/74
Dec. 3, 1974 [AU] Australia ..... 9857/74

[51] Int. Cl.[2] ..... H01H 9/00

[52] U.S. Cl. ..... 200/67 G; 200/159 A; 200/67 D; 200/243

[58] Field of Search ..... 200/159 A, 160, 243, 200/340, 273, 153 CA, 67 D, 67 DB, 67 G, 68, 76, 16 C, 16 A, 18, 303

[56] References Cited

U.S. PATENT DOCUMENTS

| | | | |
|---|---|---|---|
| 2,966,560 | 12/1960 | Gluck | 200/67 G X |
| 3,194,920 | 7/1965 | Sheib, Jr. | 200/303 |
| 3,294,942 | 12/1966 | Mason | 200/159 A |
| 3,639,714 | 2/1971 | Fujimoto | 200/67 G X |
| 3,694,590 | 9/1972 | Otterlei | 200/243 X |
| 3,701,870 | 10/1972 | Sorenson | 200/67 G X |
| 3,772,484 | 11/1973 | Roeser | 200/67 G |
| 3,924,090 | 12/1975 | Chao et al. | 200/159 A |

FOREIGN PATENT DOCUMENTS

| | | | |
|---|---|---|---|
| 593,175 | 1959 | Italy | 200/153 W |

*Primary Examiner*—J. V. Truhe
*Assistant Examiner*—Mark H. Paschall
*Attorney, Agent, or Firm*—Cushman, Darby & Cushman

[57] ABSTRACT

The present invention provides an electric switch having a linearly moveable actuator and a switch mechanism including a first electric contact which acts, in use, as a fulcrum, a second electric contact, and a contact bridging member; and constructed and arranged whereby the member is moveable slideably over the fulcrum and in so doing pivots thereabout whereby to bring the leading or trailing end of the member into or out of contact with the second electric contact.

The switch can be constructed to be double pole or single pole and double throw or single throw. It can be extended to be multithrow.

Contact bridging members which can be used include flat and arcuate members.

Abutments for engagement with the actuator can be provided by a depression in the contact bridging member or outwardly struck portions thereof.

10 Claims, 11 Drawing Figures

ELECTRIC SWITCHES

This is a continuation of application Ser. No. 634,176 filed Nov. 21, 1975 now abandoned.

BACKGROUND OF THE INVENTION

1. Field of the Invention

This invention relates to an electric switch.

Reference is made to co-pending Australian Patent Application Nos. PB 9740 and PB 9857 and to two co-pending applications filed in the same country as this application and one of which (hereinafter called "said first application") inter alia relates to an arcuately curved contact bridging member and the other of which (hereinafter called "said second application") inter alia relates to a contact bridging member having an abutment member which is an outwardly struck portion thereof.

The whole of the subject matter of all of said applications is to be considered to be imported hereinto.

Said first application bears the No. 755,584 and said second application bears the No. 752,284.

2. Summary of the Invention

The present invention provides a switch having a linearly moveable actuator, a first electric contact which acts, in use, as a fulcrum, a second electric contact, and a contact bridging member; and constructed and arranged whereby the member is moveable slideably over the fulcrum and in so doing pivots thereabout whereby to bring the leading or trailing end of the member into or out of contact with the second electric contact.

PREFERRED ASPECTS OF THE INVENTION

The actuator is preferably linearly reciprocable.

As described above, the switch is a single pole single throw switch but if the second electric contact is to one side of the fulcrum and there is a third electric contact on the opposite side of the fulcrum a single pole double throw switch can be made. Similarly, by the use of another such contact bridging member, fulcrum, second electric contact and, if desired, third electric contact, a double pole single or double throw switch may be made.

In a preferred aspect the present invention provides an electric switch having a linearly reciprocably moveable actuator; a first electric contact which acts, in use, as a fulcrum, a second electric contact and a first contact bridging member on one side of the path traversed by the actuator in linearly reciprocably moving; a third electric contact which acts, in use, as a fulcrum, a fourth electric contact and a second contact bridging member on an opposite side of said path; an aperture extending through the actuator transverse to said path, the actuator including biasing means extending through the aperture, urging the first and second contact bridging members outwardly of said path into engagement with the respective fulcrum and operative in use to transmit linear reciprocating movement of the actuator into sliding movement of the contact bridging members over the respective fulcrum and to bias the contact bridging members to pivot about the respective fulcrum to bring the leading or trailing end of the contact bridging members into or out of contact with the respective one of the second and fourth contacts.

In this construction it is preferred that the biasing means includes a coil spring extending in said aperture and having each of its ends received within a respective one of two blind sleeves which are in part received in and guided by the aperture and which transmit the bias of the spring to the contact bridging members.

It is particularly preferred that the above switch has a fifth and a sixth electric contact respectively located on said one side of the path and said opposite side of said path and on the opposite side, respectively and respective to the sliding movement of the respective contact bridging member, of the first and second fulcrums to the side thereof on which the second and fourth contacts are located and with which fifth and sixth electric contacts the trailing or leading end of the respective contact bridging member is brought out of, or into, contact in consequence of the aforesaid pivotting.

The contact bridging member may have a depression such as the dunk 37 as shown in said first application and in this case the fulcrum should be shaped to enable the dunk to pass. For example, it may have a slot similar to 106 in FIG. 7 of said first application. It is, however, preferred that the contact bridging member has the features of the contact bridging member of said second application.

Accordingly, it is preferred that the or each contact bridging member has an abutment member adapted to be acted upon by the actuator and wherein the abutment member projects from one side of the contact bridging member and is an outwardly struck portion thereof.

The contact bridging member may be flat.

The contact bridging member may be other than flat and in this case an unlimited number of electric contacts and fulcrums may be provided and in this respect reference is made to said first application.

Accordingly, it is preferred that the or each contact bridging member is so shaped and the switch is constructed and arranged such that said member in sliding in contact with the fulcrum from a first position initially rotates in one direction and in pivoting over the fulcrum rotates in the opposite direction.

If desired, means may be provided to releasably retain the actuator in one or more predetermined linearly moved positions. A number of mechanisms are known for this purpose. Alternatively, the switch may be a momentary switch.

This invention will be illustrated by way of nonlimiting examples with the aid of the accompanying drawings.

DETAILED DESCRIPTION

Figures 1, 2, 3, 4, 5, 5A, 6, 7, 8, 9, 10, 11:
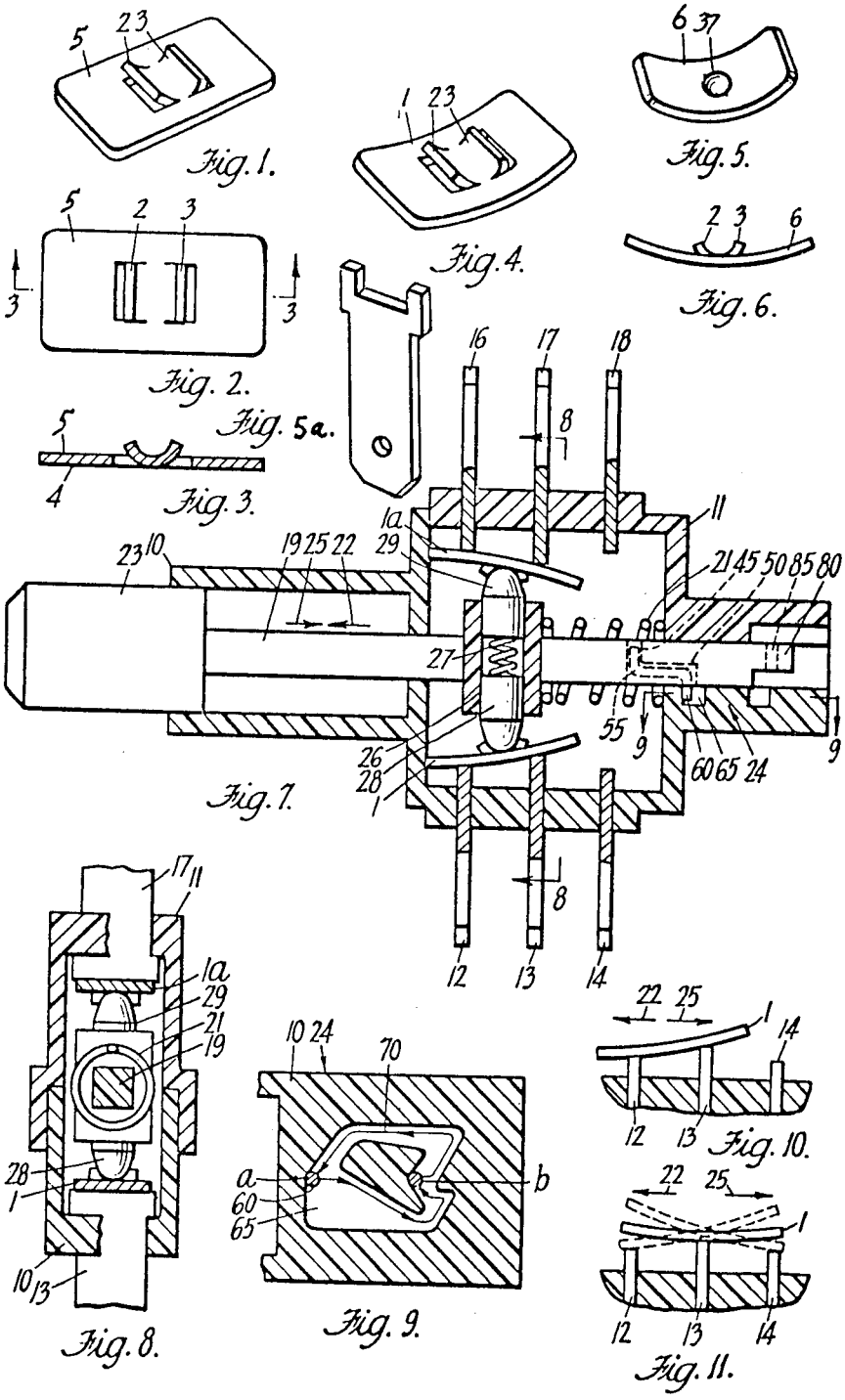
FIG. 1 is a perspective view of a first contact bridging member for use in this invention.
FIG. 2 is a plan view of the member shown in FIG. 1.
FIG. 3 is a cross-section on line 3—3 in FIG. 2.
FIG. 4 is a perspective view of a second contact bridging member for use in this invention.
FIG. 5 is a perspective view of a third contact bridging member for use in this invention.
FIG. 5*a* is a perspective view of a contact with which the member of FIG. 5 can be used.
FIG. 6 is an elevation of the member shown in FIG. 4.
FIG. 7 is a cross-section of a switch in accordance with this invention.
FIG. 8 is a cross-section on line8—8 in FIG. 7.
FIG. 9 is a cross-section on line 9—9 in FIG. 7.
FIG. 10 is a schematic representation of the operation of the switch of FIG. 7.
FIG. 11 is another schematic representation of the operatin of the switch of FIG. 7.

The contact bridging member 5 shown in FIGS. 1–3 is formed from metal strip in a single stamping operation which defines its perimeters and forms the outwardly struck portions 2 and 3 which serve as abutment members to be operated on by an actuator in an electric switch.

It will be noted particularly from FIG. 3 that the underside 4 of the member has no projections.

The contact bridging member 1 shown in FIGS. 4 and 6 is similar to that shown in FIGS. 1–3 excepting that it is curved in elevation.

The contact bridging member 6 shown in FIG. 5 is similar to that shown in FIGS. 4 and 6 excepting that it has a dunk 37 therein and a corresponding projection on its underside. In use the contact bridging member needs to be used with a contact such as the contact shown in FIG. 5*a* which has a slot 106 therein to enable the projection to pass.

A discussion of the merits of a curved contact bridging member such as members 1 and 5 over flat contact bridging members such as 6 will be found in said second application and reference is directed thereto. It is particularly to be noted that although a flat contact bridging member such as 5 can be used in the present invention it is preferred to use a curved contact bridging member such as 1 or 6.

A discussion of the merits of contact bridging members having no projections on their undersides and the abutments 2 and (such as members 1 and 5) over contact bridging members having projections on their undersides (such as member 6) will be found in said second application and reference is directed thereto. It is particularly to be noted that although a contact bridging member such as 6 can be used in the present invention it is preferred to use a contact bridging member with an underside without projections such as members 1 and 5.

Thus it will be realized that member 1 is particularly preferred.

The switch shown in FIGS. 7–9 comprises a body, comprised of a part 10 and a part 11 which snap-fittingly engage with one another, which mounts a first set of contacts 12, 13 and 14 and a second set of contacts 16, 17 and 18.

Within the body is an actuator 19 which is biassed by a spring 21 in the direction of arrow 22. The actuator is reciprocably moveable in the direction of arrow 22 and the opposite direction 25.

At one end of the actuator is mounted a pressbutton 23 and the other end of the actuator there is catch means indicated generally by 24 to be described in more detail later in this specification.

Intermediate the ends of the actuator there is a through bore 26 in which is located a coil spring 27 which bears on pins 28 and 29.

A contact bridging member is provided for each of the sets of contacts and is located by a respective one of pins 28 and 29.

The contact bridging member for contacts 12, 13 and 14 is numbered 1 and is identical in all respects to the contact bridging member 1 of FIGS. 4 and 6.

The contact bridging member for contacts 16, 17 and 18 is numbered 1*a* and is identical in all respects to member 1.

The manner of operation of the above described switch is similar in many respects to the switches shown in said first application and reference is directed thereto. However, the manner of operation is illustrated in FIGS. 10 and 11 hereof. In brief, in FIG. 10 the member 1 is shown in relation to the contacts 12, 13, and 14. By moving member 1 in the direction of arrow 22 it slides with respect to contacts 12 and 13 and because of its arcuate shape its leading and trailing ends respectively rotate anti-clockwise and clockwise. Thus the leading end also has a component of motion away from contact 14. The member 1 then comes to the position shown in the solid line in FIG. 11. However, it is to be noted that the position shown in the solide line in FIG. 11 is an unstable position. From there it may pivot to contact 14 or return to contact 12 dependant on whether the actuator is moved in the direction of arrow 22 or 24.

Member 1*a* moves similarly.

The catch mechanism, which can serve to hold the actuator in such a position that contacts 13 and 14, 17 and 18 are bridged by members 1 and 1*a* is shown particularly in FIGS. 7 and 9.

In this respect, the actuator has a hole 45 and a relieved portion 50 both of which are shown by dash lines. A generally Z-shaped member 55 (shown in dotted line in FIG. 8) is received at one end in hole 45 and the other end, 60, is located in a channel 65 of particular form in body part 10 (see, particularly, FIG. 9).

Operation of the actuator causes the end 60 to move in the channel as shown by the line 70 and in the directions indicated by arrow heads. The end 60 is stable only when in the positions denoted by *a* and *b* which correspond, respectively, to the position of the actuator shown in FIG. 7 and a position in which contacts 13 and 14, and contacts 17 and 18 are bridged by members 1 and 1*a*; all other positions are unstable and tend to revert to one or other of the stable positions.

The switch shown in FIGS. 7–9 is a double pole, double throw switch and may be modified by omitting contacts 16, 17 and 18 to make it single pole, double throw or contacts 14, 16, 17 and 18 to make it single pole, single throw. Other modifications will be apparent.

In the switch described above with respect to FIGS. 7–9, advantages accrue from the use of the contact bridging member.

Among those advantages are those consequent on its arcuate shape and reference is made to said first application for a description of these.

Other advantages are consequent on the contact bridging member having outwardly struck abutments and the co-operation of the contact bridging member with the contacts 13 and 17 which, it is to be noted, do not have the slot 106 of the contact shown in FIG. 7 of said first application and reference is made to said second application for a description of these.

A typical switch in accordance with FIGS. 7–9 of the drawings has contacts which are all the same and the contacts are mounted at slightly different levels in consequence of casing formations. The contacts are about 0.05mm. thick about 18mm. long and are contacted over a width of about 6mm. by the contact bridging member and have a maximum width of about 7mm. The contacts are located in the casing so that the casing interior ends of contacts 13 and 17 lie in planes spaced about 0.5mm. or less from planes including the casing interior ends of contacts 12 and 14 and 16 and 18 and the contacts are spaced from adjacent contacts at centres spacings of about 6.5mm. and adjacent surface spacings of about 5.5mm.

The contact bridging member of that typical switch is arcuate, has a developed length of about 13.5mm., has a radius of arcuate curvature of about 44.5mm., is about 0.7mm. wide, has the abutment members struck out from a portion about 3.6mm. wide and about 4.7mm. long and wherein the abutment members and the portion of the contact bridging member between them define a curved surface for receiving pins 28 or 29 of a radius of about 1.2mm.

Further, the corners of the contact bridging member are rounded at a radius of about 0.8mm. This slight rounding is of some significane in that in early experiments applicant merely trimmed right angled corners at 45° (trimming off a portion with sides adjacent the right angle of about 2mm. In length) and found that the contact bridging member, by being comparitively pointed had a tendency to arc. Leaving the corners square was not considered practical as such corners can often be sharp and thus a small rounding was chosen. Still further, this trimming of the surface as 45° reduced the wiping surface thus reducing self cleaning.

Thus, it is generally preferred that the corners of the contact bridging member are radiused at a radius of not more than one-fifth of their width or if otherwise trimmed so as not to reduce the length of the leading end by more than 1/5th. of the width preferably not more than 1/10th. of the width.

The above described switch can also be modified in a number of other ways.

For instance, the catch means 24 can be omitted so that the switch is made momentary. Further contacts can be added and also further contact bridging members may be added.

The member 5 can be used in lieu of member 1 but if this is done it will probably be necessary to increase the spacing of the ends of the contacts 13 and 17 from planes including contacts 12 and 14 and 16 and 18 so as to ensure that the contact bridging member 5 does not approach sufficiently close to a contact to permit arcing until it is actually about to pivot.

The member 6 might be used in lieu of members 1 and if this is done contacts 13 and 16 will need to permit the projection consequent on the dunk 37 to pass and may take the form shown in FIG. 5*a*.

Many modifications and adaptations may be made to the inventions described above without departing from the spirit and scope of this invention which includes every novel feature and combination of features disclosed herein.

The claims form part of the disclosure of this specification.

I claim:

1. An electric switch having a linearly reciprocably moveable actuator; a first electric contact which acts, in use, as a fulcrum, a second electric contact and a first contact bridging member on one side of the path traversed by the actuator in linearly reciprocably moving; a third electric contact which acts, in use, as a fulcrum, a fourth electric contact and a second contact bridging member on an opposite side of said path; an aperture extending through the actuator transverse to said path, the actuator including biasing means extending through the aperture, urging the first and second contact bridging members outwardly of said path into engagement with the respective fulcrum and operative in use to transmit linear reciprocating movement of the actuator into sliding movement of the contact bridging members over the respective fulcrum and to bias the contact bridging members to pivot about the respective fulcrum to bring the leading or trailing end of the contact bridging members into or out of contact with the respective one of the second and fourth contacts;

the biasing means including a coil spring extending in said aperture and having each of its ends received within a respective one of two blind sleeves which are in part received in and guided by the aperture and which transmit the bias of the spring to the contact bridging members;

each contact bridging member having means defining a pair of longitudinally spaced, opposed abutments thereon which are effective on that side of the respective contact members which is remote from the respective contacts for engagement by the respective blind sleeves externally of said blind sleeves for translating reciprocating movement of said actuator into rocking, sliding movement of said contact bridging members in the absence of mechanical pinning of the contact bridging members to the blind sleeves.

2. An electric switch as claimed in claim 1 and including a fifth and a sixth electric contact respectively located on said one side of the path and said opposite side of said path and on the opposite side, respectively and respective to the sliding movement of the respective contact bridging member, of the first and second fulcrums to the side thereof on which the second and fourth contacts are located and with which fifth and sixth electric contacts the trailing or leading end of the respective contact bridging member is brough out of, or into, contact in consequence of the aforesaid pivotting.

3. An electric switch as claimed in claim 1 wherein the switch has a hollow casing which is open at opposite ends and wherein the actuator extends between those ends and is accessible through those ends.

4. An electric switch as claimed in claim 1 wherein the switch has a two part casing and wherein one of the parts carries the first and second electric contacts and the other of the parts carries the third and fourth electric contacts.

5. An electric switch as claimed in claim 1, wherein the actuator applied force to each of said members at an area intermediate its ends and on one side thereof, each of said members has an opposite side which, in use, contacts the respective said contacts, said opposite side of each of said members being compirsed of first and second surface portions which are at an angle to one another and which surface portions, in a first position of each of said members, contact, respectively, the first and second, and third and fourth contacts, and are inclined to a straight line joining surfaces of said contacts which are contacted by each of said members when in said first position and said area is located to the side of the respective said fulcrum adjacent, respectively, the second and fourth contacts whereby to closely nest part of each of said members with and between, respectively, the first and second, and third and fourth contacts, said force is applied in a direction urging said part of each of said members into such nesting relation and wherein each of said members is so shaped and located and the switch is constructed and arranged such that said members are movable by the actuator from the first positions, slidably with respect to the respective ones of said contacts and in so doing the trailing ones of said surface portions move with a component of motion in said direction of said force such that each of said members initially rotates in a direction, said part of each of said members moves to become relatively less nested and does so against said force tending to restore it to the nested condition, said area of each of said members approaches the respective said fulcrum, and thereafter after said area of each of said members has passed the respective said fulcrum in a rotation of opposite direction whereby to come out of contact with, respectively, the first and third contacts.

6. An electric switch as claimed in claim 5, wherein each said opposite side has an arcuate shape.

7. An electric switch as claimed in claim 5, wherein each said opposite side has two end portions and a portion intermediate the two end portions and wherein the end portions are inclined to the intermediate portion.

8. An electric switch as claimed in claim 5, wherein each said fulcrum is defined by an edge of a strip of metal.

9. An electric switch as claimed in claim 1, wherein: each said abutment is constituted by a tongue-like tab struck outwardly from the respective contact bridging member, the resulting two tongue-like tabs on each contact bridging member being rooted proximally of one another and being free distally of one another.

10. An electric switch as claimed in claim 9, wherein each said fulcrum is defined by an edge of a strip of metal and wherein the respective contact bridging member extends at least substantially the full length of said edge.

* * * * *